US011608679B2

(12) United States Patent
Schmidt

(10) Patent No.: US 11,608,679 B2
(45) Date of Patent: Mar. 21, 2023

(54) AUTOMATED TILT WAND CONTROLLER FOR WINDOW BLINDS

(71) Applicant: Daniel Schmidt, Woodbury, MN (US)

(72) Inventor: Daniel Schmidt, Woodbury, MN (US)

(73) Assignee: Daniel Schmidt, Woodbury, MN (US)

( * ) Notice: Subject to any disclaimer, the term of this patent is extended or adjusted under 35 U.S.C. 154(b) by 7 days.

(21) Appl. No.: 16/949,481

(22) Filed: Oct. 30, 2020

(65) Prior Publication Data

US 2021/0131176 A1 May 6, 2021

Related U.S. Application Data

(60) Provisional application No. 62/928,864, filed on Oct. 31, 2019.

(51) Int. Cl.
*E06B 9/322* (2006.01)
*E06B 9/38* (2006.01)

(52) U.S. Cl.
CPC ..... *E06B 9/322* (2013.01); *E06B 9/38* (2013.01)

(58) Field of Classification Search
CPC ..... A47H 5/0325; E06B 9/322; E06B 9/326; E06B 9/38; E06B 9/74; E06B 9/78; E06B 9/307; E06B 2009/285
USPC ..... 160/168.1 P, 176.1 P
See application file for complete search history.

(56) References Cited

U.S. PATENT DOCUMENTS 1,978,152 A * 10/1934 Ward ..... E06B 9/30 160/171
2,149,481 A * 3/1939 Van Bosch ..... E05F 15/71 160/168.1 P
2,962,647 A * 11/1960 Borenstein ..... G05D 3/127 318/480
3,269,454 A * 8/1966 Gill ..... E05F 15/605 160/331
4,456,049 A * 6/1984 Vecchiarelli ..... E06B 9/307 160/107
4,979,550 A * 12/1990 Long ..... E06B 9/74 160/5
5,175,478 A * 12/1992 Chen ..... E06B 9/32 160/DIG. 17
5,444,339 A * 8/1995 Domel ..... E06B 9/307 318/17
5,547,008 A * 8/1996 Sullivan ..... E06B 9/32 160/176.1 P
5,760,558 A * 6/1998 Popat ..... E06B 9/32 318/480
5,907,227 A * 5/1999 Domel ..... E06B 9/32 318/480
7,089,988 B2 * 8/2006 Coleman ..... E06B 9/32 160/168.1 R
2008/0303686 A1 * 12/2008 Mosbrucker ..... E06B 9/322 340/4.61
2017/0362888 A1 * 12/2017 Vinogradova ..... E06B 9/32
2019/0264502 A1 * 8/2019 Marocco ..... E06B 9/50

* cited by examiner

*Primary Examiner* — Johnnie A. Shablack
(74) *Attorney, Agent, or Firm* — Patterson Thuente, P.A.

(57) ABSTRACT

An automated tilt wand controller could precisely control the tilt of a plurality of slats of installed window blinds using an actuator to turn a tilt wand. A remote or mobile device could be used to control the automated tilt wand controller.

4 Claims, 6 Drawing Sheets

AUTOMATED TILT WAND CONTROLLER FOR WINDOW BLINDS

RELATED APPLICATION

The present application claims the benefit of U.S. Provisional Application No. 62/928,864 filed Oct. 31, 2019, which is hereby incorporated herein in its entirety by reference.

TECHNICAL FIELD

This disclosure relates generally to operation of window coverings, specifically to a device for motorized, automated operation of conventional horizontal Venetian blinds and other window coverings.

BACKGROUND

Venetian window blinds typically include a plurality of horizontally arranged parallel slats suspended by lifting cords. The lifting cords hang from a head rail mounted near the top of a window and are attached to a bottom rail located beneath the bottom-most slat.

The amount of light passing through the blinds can be controlled in either of two ways. First, the slats can be drawn towards the head rail by pulling the free ends of the lifting cords, known as pull cords. The slats are secured at a desired height using cord locks located at the head rail. Releasing the cord lock allows the slats to be lowered. Second, the tilt angle of the slats can be adjusted. In most modern blinds, this is done by twisting a tilt wand (also called a rod) that hangs from a short shaft protruding from the head rail. Tilt wands are a design choice of the manufacturer and vary in length and materials. In operation, the angle of the slats may be changed by rotating the tilt wand clockwise or counter-clockwise. This tilt adjustment provides a fine degree of illumination and privacy control.

Other types of venetian blinds are also in use. Vertical venetian blinds typically include slats that are suspended vertically from a head rail and two cords used to independently adjust slat tilt and to move the slats horizontally. However, the tilt wand implementation of horizontal venetian blinds is one of the most prevalent types of venetian blinds due to its relatively low cost. In some applications, particularly in commercial office buildings, horizontal venetian blinds are one of the most popular window coverings in number of installed units.

In conventional systems, manually controlling the tilt adjustment of the slats requires a user to be in close proximity to the window blinds in order to reach and operate the tilt wand. This may be difficult if the path to the window is obstructed or if the window is in a hard-to-reach location.

Automated tilt adjustment of slats for window blinds can provide substantial benefits in increased convenience and utility. Automated operation of venetian blinds can help save energy through passive heating, by angling blinds closed during the night and open during the day during winter months, and cutting air conditioning costs, and by closing the blinds during the day in summer months. In residential applications, automated operation can save considerable time and effort, especially in situations where the window is in hard-to-reach locations. Further, automated operation can serve as a meaningful improvement for the physically-impaired to independently control their living environment.

Many current applications of window blinds automation are not conducive to being low cost, a key feature of horizontal venetian blinds. The cost of automation is primarily determined by the cost of the automation equipment and installation costs. Automation equipment that is not compatible with existing window coverings can significantly increase the cost of implementation as there is lost investment in the installation of existing window coverings and the added cost of their removal. Generally, for window blind automation to be cost-effective, the total cost of implementing automation should not substantially exceed the purchase cost of a standard venetian blind. However, conventional approaches for venetian blind automation involve significant costs and installation difficulties, often requiring removal of the head rail.

One conventional approach to window blind automation involves inserting a motor into a head rail of previously installed window blinds. This approach requires a complicated installation process, including dismounting each head rail to realign the conventional shaft and pulley system to pass into the motor. Additionally, this approach can require a height adapter to fit the motor into the existing head rail, adding cost. After installation, this head rail motor approach is difficult to maintain due to the location of the motor. Typically, because the motor is located above the window, a cumbersome solar panel apparatus or battery power is used to power the motor. If battery power is used, the user must dismount the head rail each time the battery must be replaced or recharged, making the system particularly inefficient.

A second conventional automation approach for window blinds involves replacement of the existing tilt wand with a motorized wand. Motorized wands are expensive due to their sizing constraints and mechanical complexity. Further, installation of such wands frequently requires mounting kits. Due to the location of the motorized wand in front of the window, motorized wands generally rely on battery power for a reduced profile. However, the sizing constraints on motorized wands often lead to expensive battery solutions or batteries with relatively short charges. Frequent changing of batteries for the motorized wands can be challenging for the physically-impaired as the wands usually hang from a high height and require the user to remove and remount the wand each time.

A third conventional approach incorporates a bracket system placed externally around the head rail where the tilt wand connects to the small shaft. This bracket system uses a motor to turn the small shaft protruding from the head rail. The bracket must fit over the head rail during installation, in some cases requiring removal of the head rail and window blind. In cases where solar power is used, removal of the blind is occasionally necessary to install appropriately sized solar panels to power the motor. In addition to these installation difficulties, this bracket approach requires an intricate replacement process if solar power is not used. If the bracket system is powered by a plug-in system a plug wire would have to extend the length of the window and could become tangled in the lifting cords. Further, the design restrictions of fitting a bracket over the head rail make the applicability of the bracket system dependent on variances in each window setup due to little clearance between the head rail and window frame in most setups, complicating widespread use.

Ultimately, the use of conventional automation systems generally results in loss of the investment in existing window coverings, including the costs of their original installation. This lost investment can quickly dwarf the cost of standard Venetian window blinds. The lower end of this lost investment represents add-on systems that are compatible with the original blinds, while the upper end of this range represents all other prior art systems for venetian blind automation. In general, the overall cost of conventional automation systems tend to be many times that of standard venetian blinds. This high cost restricts the application of automated Venetian window blinds from widespread usage. In particular, high cost has prevented considerable energy-savings from reaching many commercial buildings. Finally, the high cost has also severely limited the use of automated venetian blinds among the physically impaired, many of whom could substantially benefit from the ease of use.

SUMMARY

Embodiments of the present disclosure present a cost-effective solution for automating tilt control of window blinds while remaining accessible in difficult-to-reach locations and to the physically impaired.

In accordance with one embodiment of the disclosure, there is provided an automated tilt wand controller for efficiently operating the tilt wand of Venetian window blinds without requiring replacement or removal of any element of existing window blinds. An automated tilt wand controller for window blind wands is configured to rotate the tilt control wand remotely, allowing a user to simultaneously close or open multiple window blinds using a remote or mobile device, such as a Smartphone. Because the automated tilt wand controller can be used with any existing tilt wand there is no lost cost from prior installation fees or replacement parts. Further, the design of the automated tilt wand controller simplifies installation and maintenance.

In embodiments, an automated tilt wand controller can include a control module, a mechanical actuator, at least one power source, at least one sensor, an Infrared (IR) receiver, a Bluetooth receiver, a Wi-Fi signal receiver, and at least one output device. For most embodiments of the automated tilt wand controller the control module need only provide modest computational performance or throughput. To reduce cost and prolong battery usage, the control module can be a low-power type.

In embodiments, an automated tilt wand controller can be remotely operated using an IR remote, Bluetooth, or Wi-Fi. At least one external indicator light on the automated tilt wand controller can be used to indicate connection status of the automated tilt wand controller when pairing with a remote device. In embodiments, the automated tilt wand controller can be controlled via a smart phone application.

In embodiments, the at least one power source can be a battery, and the battery can be rechargeable. In embodiments, an external indicator light can be used to indicate when battery level is low and in need of charging or replacement. In embodiments, automated tilt wand controller can be electrically powered using a power cord and a plug. The power cord can be retractable when not in use via a reel. In other embodiments, the automated tilt wand controller can be solar powered using a solar panel.

In embodiments, the automated tilt wand controller can contain at least one sensor, such as a photosensor capable of generating electric signals in response to the ambient degree of illumination. The photosensor can be used in conjunction with the control module to sense the transition from night-time to day-time at dawn and from day-time to night-time at dusk.

In embodiments, the automated tilt wand controller can allow users to schedule times to automatically open or close windows. Scheduled control of blinds while an owner is away can improve security in a residential setting by making the home appear occupied.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
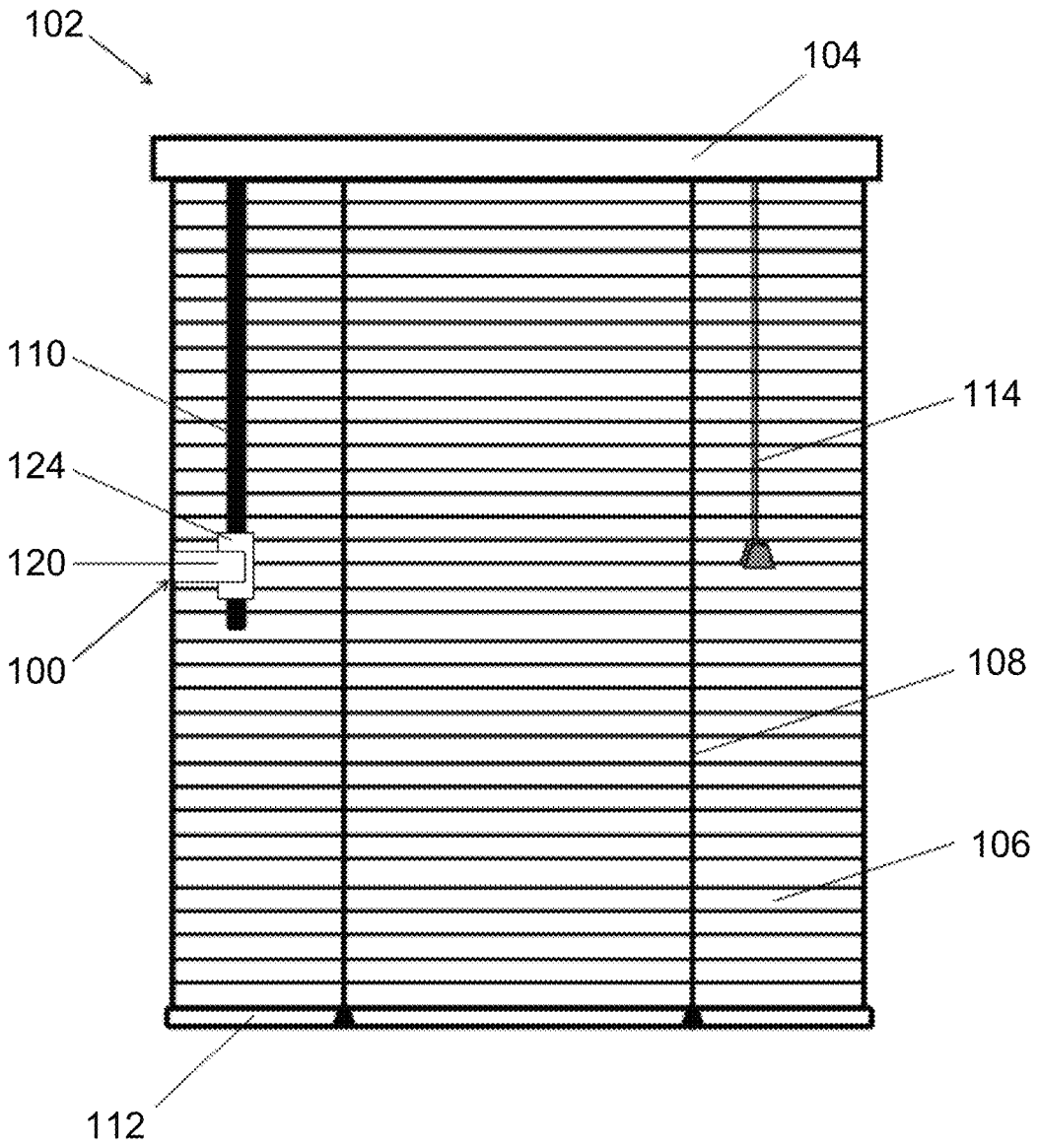
FIG. 1 is a front view of Venetian window blinds with an automated tilt wand controller according to an embodiment.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

Referring to FIG. 1, an automated tilt wand controller 100 and Venetian window blinds 102 are depicted. Venetian window blinds 102 conventionally include a head rail 104 from which slats 106 are suspended by a lifting cords 108. Head rail 104 is generally in the shape of a rectangular box with an open top where a support bracket attaches head rail 104 to a window frame, ceiling, wall, or other support structure. Head rail 104 is generally made of metal or plastic, and slats 106 are generally made of wood, vinyl, or aluminum, though a variety of other materials or combinations of materials also can be used.

The amount of light passing through Venetian window blinds 102 can be controlled by adjusting the tilt of slats 106 using a tilt wand 110. Tilt wand 110 hangs from head rail 104 and is operably coupled to a mechanism that can lengthen and contract individual lifting cords 108 relative to each other. Tilt wand 110 provides a fine degree of accuracy in the amount of light passing through the slats 106. Alternatively, lifting cords 108 are attached to bottom rail 112 and can be raised and lowered using pull cords 114. Pull cords 114 are secured at a desired length using cord locks located at head rail 104. Releasing the cord lock allows slats 106 to be lowered.

Automated tilt wand controller 100 can be removably coupled to a surface adjacent to tilt wand 110. Automated tilt wand controller 100 includes a housing 120 and a wand holder 124 that is operably coupled to the tilt wand 110. Automated tilt wand controller 100 can be operably coupled to tilt wand 110 at any point along the length of tilt wand 110.

Figure 2:
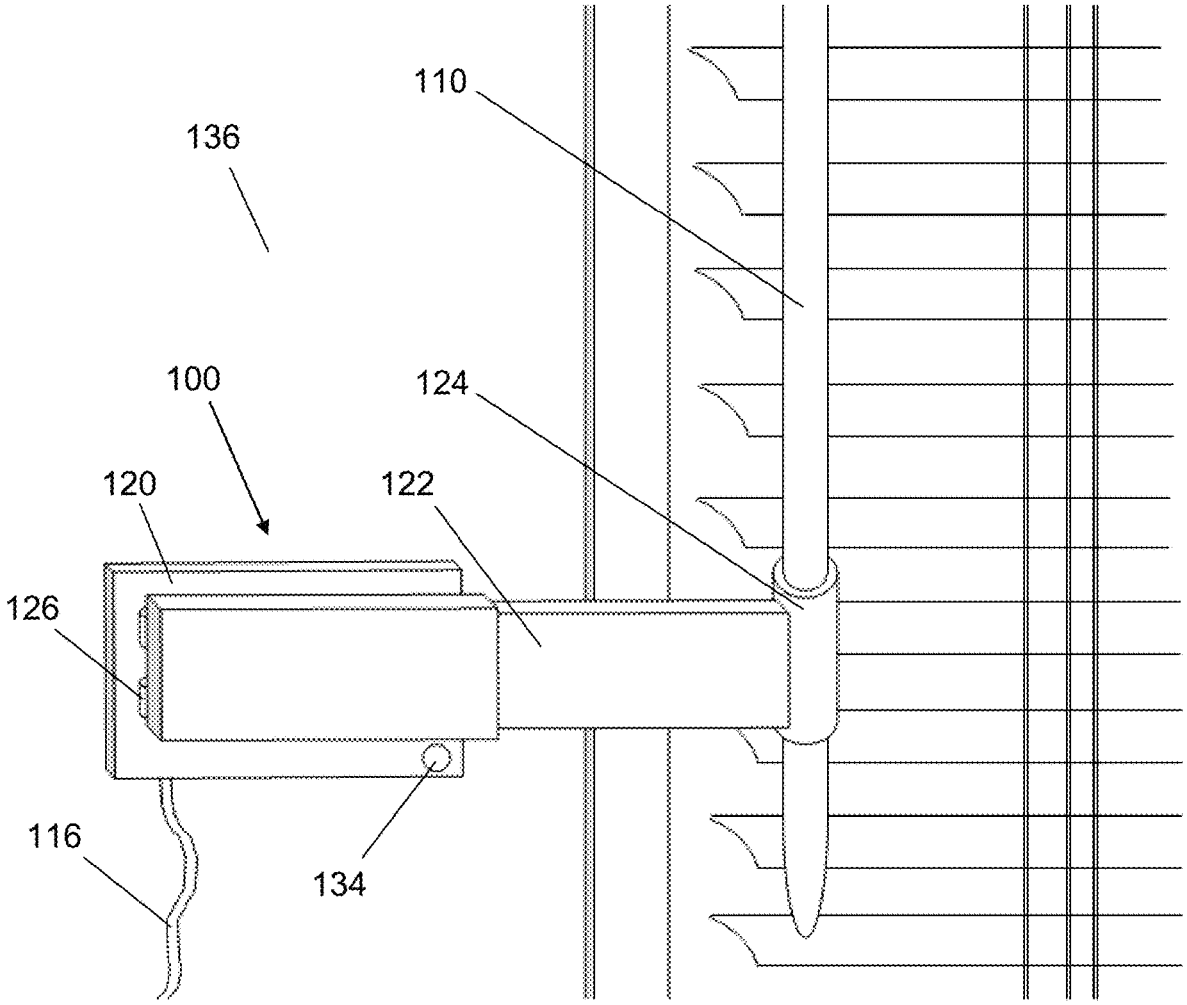
FIG. 2 is a front view of an automated tilt wand controller with a wand holder arm according to an embodiment.
Figure 6:
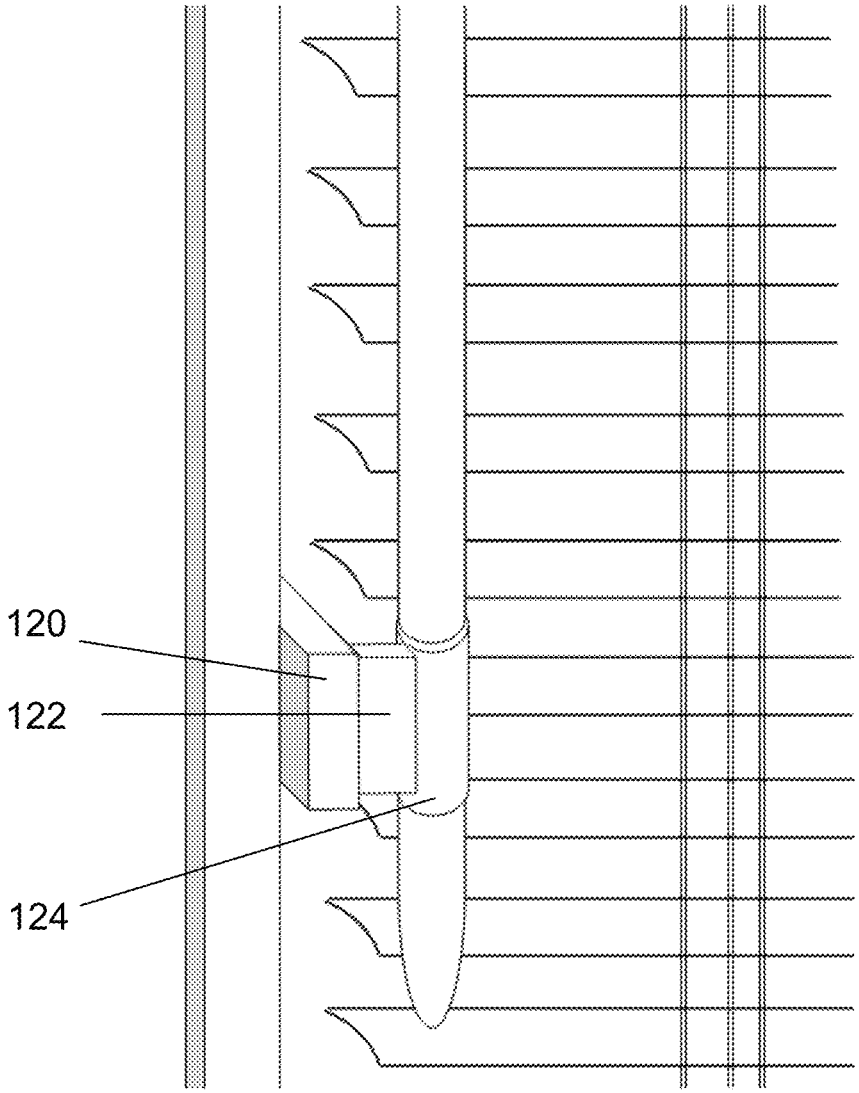
FIG. 6 is a front view of an automated tilt wand controller according to an embodiment.

In embodiments, automated tilt wand controller 100 can be oriented in a window position, a wall position as shown in FIG. 2, or a window frame position as shown in FIG. 6. In embodiments, automated tilt wand controller 100 can be coupled to surfaces in a variety of ways. For example, in one embodiment housing 120 can include stretch releasing adhesive tapes. Commercial stretch releasing adhesive tapes include the product sold under the trade designation COMMAND by Minnesota Mining and Manufacturing Company, St. Paul, Minn., and the product sold under the trade designation POWER-STRIPS by Beiersdorf AG, Hamburg, Germany. In embodiments, housing 120 can include suction cups to attach to a window. In embodiments, housing 120 can incorporate a hook, aperture, or ridge that can be used in conjunction with a screw, nail or other fastener protruding from a surface adjacent to Venetian window blinds 102. In embodiments automated tilt wand controller 100 can be coupled to a wooden window frame using a wood screw. In embodiments, ways to attached automated tilt wand controller 100 to a surface and automated tilt wand controller 100 may be packaged together as a kit.

Referring to FIG. 2, in one embodiment automated tilt wand controller 100 includes a housing 120, at least one wand holder arm 122, and wand holder 124. In the depicted embodiment, housing 120 is pivotally coupled to wand holder arm 122 via at least one pivot joint 126. The at least one pivot joint 126 can be a hinge joint. Wand holder arm 122 is coupled to wand holder 124. The at least one pivot joint 126 can change the degree of separation or rotation between wand holder arm 122 and a wall 136 or other adjacent surface. For example, in the depicted embodiment, pivot joints 126 can allow wand holder 124 to operably couple to tilt wand 110 regardless of potential differences in how far tilt wand 110 may hang from wall 136 relative to the wand holder arm 122. Wand holder arm 122 can be a telescoping arm capable of extending or retracting relative to the position of housing 120. Wand holder arm 122 can extend or contract depending on the distance from automatic tilt wand controller 100 to tilt wand 110.

Figure 3:
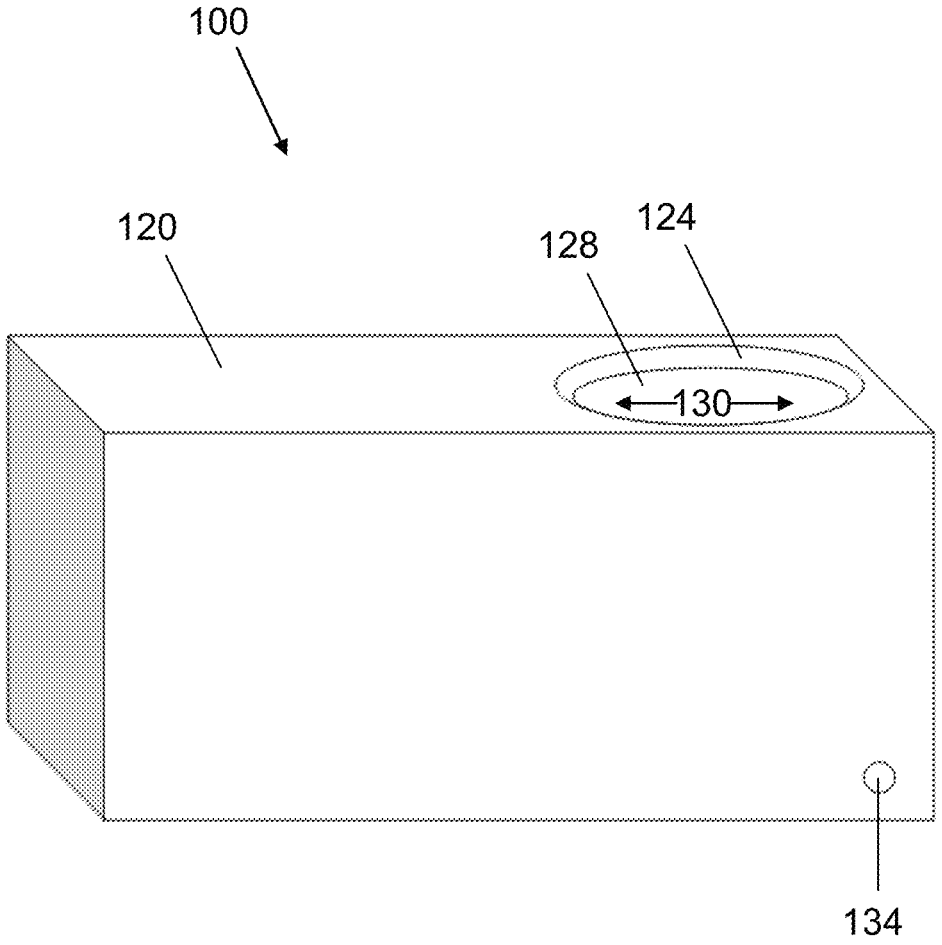
FIG. 3 is a front view of an automated tilt wand controller according to an embodiment.

Referring to FIG. 3, in another embodiment housing 120 can encompass wand holder 124. Thus, housing 120 can be directly coupled to wand holder 124 without the need for the at least one wand holder arm 122. Wand holder 124 includes a wand holder sidewall 128 defining chamber 130.

Figure 4:
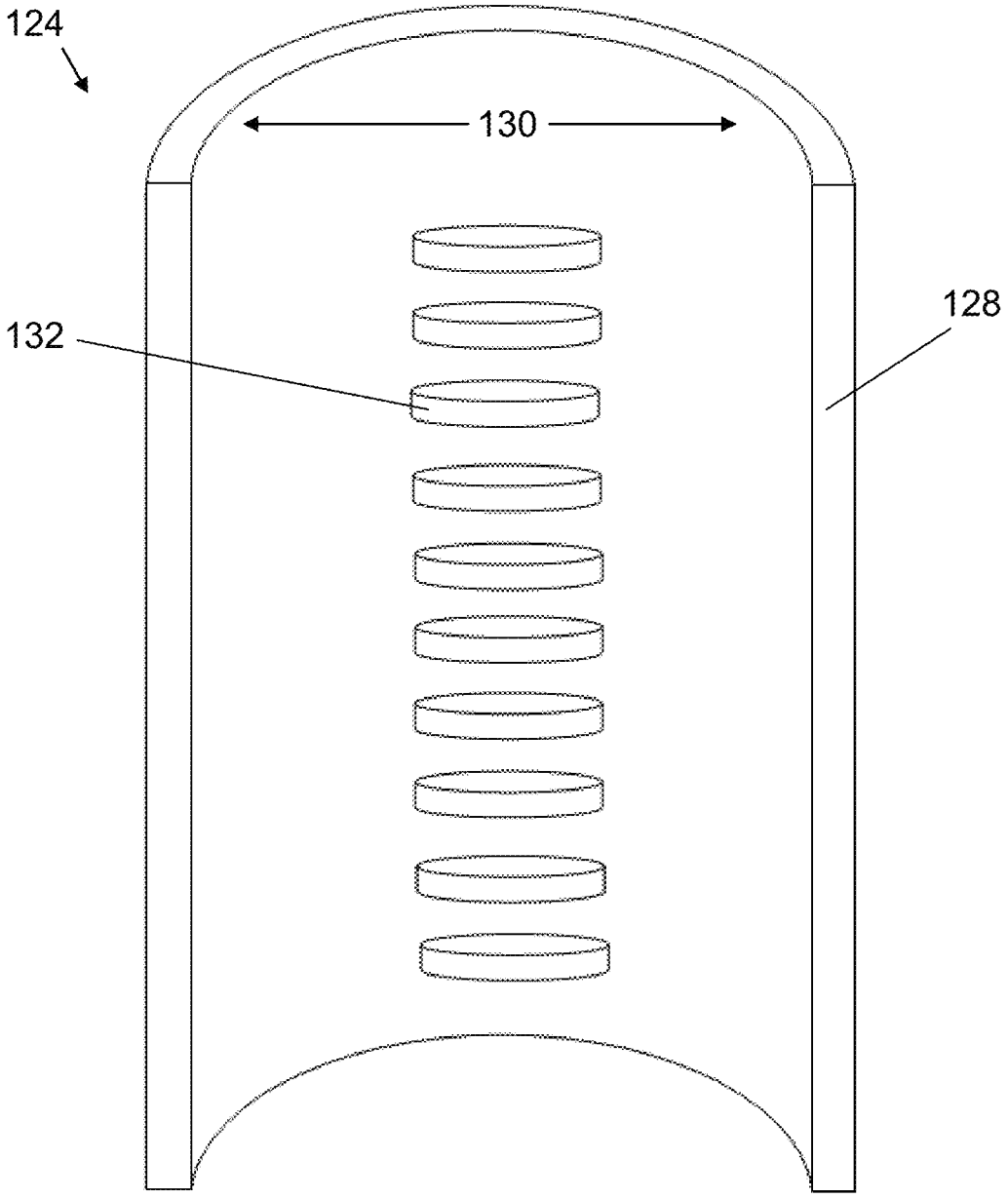
FIG. 4 is a front sectional view of the interior of a wand holder according to an embodiment.

Referring to FIG. 4, a sectional view of wand holder 124 is depicted. In some embodiments the portion of a wand holder sidewall 128 facing chamber 130 can include at least one wand holder wheel 132. In operation, tilt wand 110 can be slid into chamber 130 and secured via a transition fit or interference fit with wand holder 124. The at least one wand holder wheel 132 can be biased against tilt wand 110. The interference fit can be adjusted by biasing the at least one wand holder wheel 132 into wand hand sidewall 128. In embodiments, wand holder sidewall 128 and the at least one wand holder wheel 132 can be made of malleable or compressible materials, such as rubber, plastics, or composites, to account for different sizes of tilt wands. In embodiments, wand holder wheel 132 may be replaced by wand holder grips.

Figure 5:
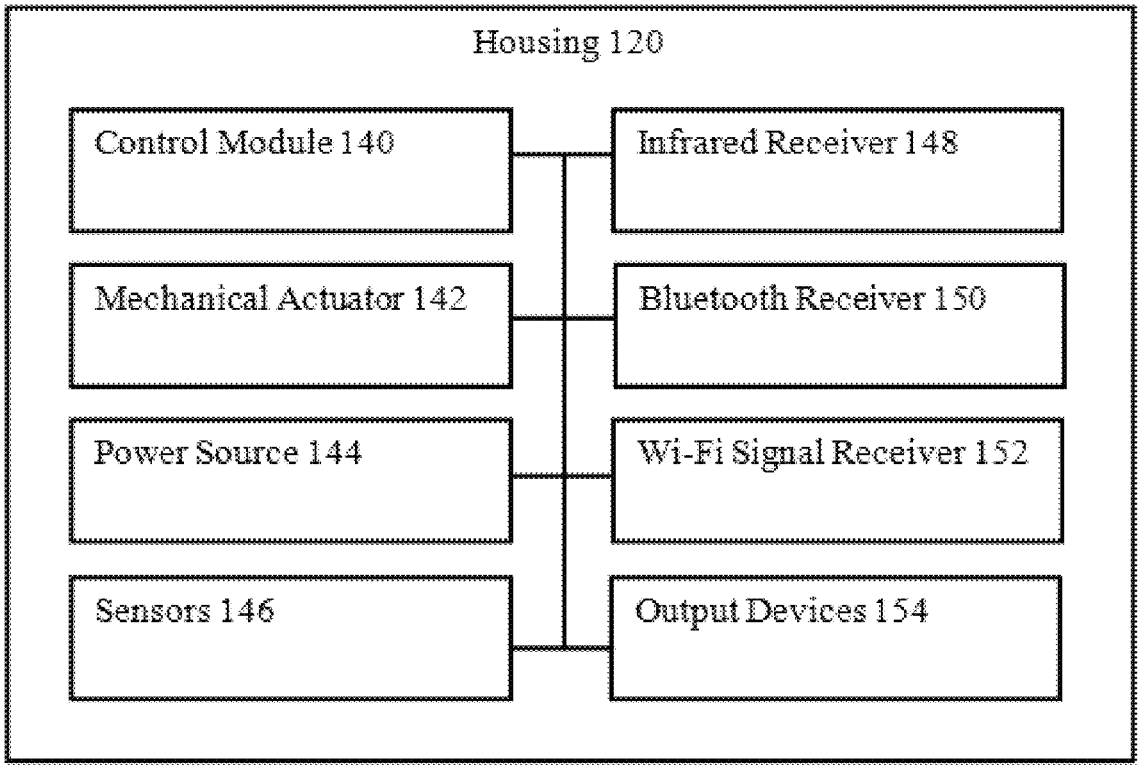
FIG. 5 is a block diagram of automated tilt wand controller components according to an embodiment.

FIG. 5 is a block diagram of components within housing 120 that are connected via a bus according to an embodiment. Housing 120 can include a control module 140, a mechanical actuator 142, at least one power source 144, at least one sensor 146, an Infrared (IR) receiver 148, a Bluetooth receiver 150, a Wi-Fi signal receiver 152, and at least one output device 154 connected via a bus. At least one power source 144 provides power to the components included in FIG. 5, allowing (among other things) for periodic monitoring of at least one receiving device. The at least one receiving device can include IR receiver 148, Bluetooth receiver 150, or Wi-Fi signal receiver 152. Upon receiving, by a receiving device, a request to adjust the tilt of slats 106, control module 140 can turn mechanical actuator 142 thereby rotating tilt wand 110 if tilt wand 110 is properly inserted into wand holder 124. Similarly, control module 140 can periodically monitor at least one sensor 146 and turn the tilt wand if a set condition is met by the sensor data. Control module 140 can manage at least one output device 154 to facilitate operation and setup of automated tilt wand controller 100 by a user.

For most embodiments of automated tilt wand controller 100 the control module 140 need only provide modest computational performance or throughput. To reduce cost and minimize power usage, control module 140 should preferably be a low-power type.

Automated tilt wand controller 100 can be controlled remotely by receiving signals through at least one receiving device in housing 120. In embodiments, Bluetooth, IR, and Wi-Fi can be used to remotely operate automated tilt wand controller 100 through remotes or mobile devices, such as Smartphones. In embodiments, this remote operation can be done through an interface, such as a Smartphone application, or through voice commands facilitated by AI, such as Amazon's Alexa or Apple's Siri. In embodiments, information about the status of automated tilt wand controller 100 including the charge of batteries, the current state of Venetian window blinds 102, and information from the at least one sensor 146 can be presented to a remote or mobile device using the at least one output device 154. At least one output device 154 can be used to indicate connection status of automated tilt wand controller 100 when pairing with a remote device or connecting to Wi-Fi. In embodiments, a plurality of window blinds can be grouped to allow for simultaneous control or synced settings. For example, all the window blinds in an office can be grouped and set to open during work hours and to close at night.

In embodiments, power source 144 can include power cord 116 and a plug, as shown in FIG. 2. In embodiments, the at least one power source 144 can be a battery, such as a replaceable or rechargeable battery. Power cord 116 can be retractable into housing 120 when not in use via a reel. In other embodiments, automated tilt wand controller 100 can be solar powered using a solar panel that can be placed against a window.

In embodiments, housing 120 can contain at least one sensor 146, such as a photosensor capable of generating electric signals in response to the ambient degree of illumination. The photosensor can be used in conjunction with the control module 140 to sense the transition from night-time to day-time at dawn and from day-time to night-time at dusk. In other embodiments, the at least one sensor 146 may be used to detect temperature or movement.

In embodiments, at least one output device 154 could be a display screen or a speaker. In embodiments, at least one output device 154 can be indicator light 134, as seen in FIG. 2, that can be used to indicate when battery level is low. Further, at least one output device 154 can be used in establishing a connection between a device and the receiver, such as a Bluetooth connection, by indicating when Bluetooth receiver 150 is ready to pair or has successfully paired with a device. In embodiments control module 140 can communicate with a remote device, such as a Smartphone, using at least one output device 154 to indicate the current status of automated tilt wand controller 100.

In one embodiment, installing automated tilt wand controller 100 includes inserting tilt wand 110 into chamber 130 such that housing 120 is facing an adjacent surface and coupling automated tilt wand controller 100 to the adjacent surface by a chosen method. An alternate method of installation includes coupling automated tilt wand controller 100 to a surface adjacent to the Venetian window blinds and then inserting tilt wand 110 into chamber 130, temporarily detaching tilt wand 110 from head rail 104 if necessary. In embodiments, instructions for installation and proper use can be packaged with the automated tilt wand controller 100. In embodiments, these instructions for installation and proper use may include diagrams and step-by-step guides for use of features of automated tilt wand controller 100.

In operation, automated tilt wand controller 100 can be used to rotate tilt wand 110 to precisely adjust Venetian window blinds 102. The mechanical actuator 142 within housing 120 can be used to turn at least one wand holder wheel 132 thereby rotating tilt wand 110 and adjusting the tilt of slats 106. In embodiments, the mechanical actuator 142 can be used to rotate wand holder 124. The tilt of slats 106 can be adjusted by rotation of wand holder 124 when coupled to tilt wand 110, such as when using wand holder grips.

In embodiments, automated tilt wand controller 100 can be placed at the bottom of tilt wand 110 such that it is easily accessible. In embodiments, tilt wand 110 may not pass the entire way through wand holder 124. Installing automated tilt wand controller 100 towards the bottom of tilt wand 110 facilitates battery replacement and other maintenance.

The versatility of attachment means that are compatible with automated tilt wand controller 100 allows for easy installation on a variety of surfaces. As seen in FIG. 6 the wand holder arm 122 allows housing 120 to be located between Venetian window blinds 102 and a window in some arrangements.

Regardless of a particular actuator or mode of attachment, it is to be appreciated and understood that an automated tilt wand controller such as has been described by example or otherwise contemplated herein could advantageously provide a relatively low-cost way of accurately setting the tilt of slats for Venetian window blinds.

Thus, in one embodiment, a system for automated operation of venetian blinds comprises a housing coupleable to a surface adjacent to and separate from a venetian window blind, the housing including a mechanical actuator including an output member, at least one receiver configured to receive a request to operate the mechanical actuator, and a control module coupled to the at least one receiver and the mechanical actuator and configured to cause the mechanical actuator to actuate based on the request; a tilt wand holder coupled to the housing, the tilt wand holder including a chamber configured to removably receive a tilt wand of the venetian window blind, the chamber arranged such that actuation of the mechanical actuator causes the tilt wand to rotate within the tilt wand holder.

The receiver can be at least one of an infrared receiver, a Bluetooth receiver, or a Wi-Fi signal receiver.

The tilt wand holder can be coupled to the housing by an arm, the arm including a first end connected to the housing and a second end coupled to the tilt wand holder. The first end of the arm can be coupled to the housing by at least one pivot, the at least one pivot allowing the arm to rotate relative to the housing. The arm can be a telescoping arm configured to extend outward from the housing.

The tilt wand holder can extend through the housing.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

The invention claimed is:

1. A system for automated operation of venetian blinds, comprising:

a housing coupleable to a surface adjacent to and separate from a venetian window blind, the housing including:

a mechanical actuator including an output member, at least one receiver configured to receive a request to operate the mechanical actuator, and a control module coupled to the at least one receiver and the mechanical actuator and configured to cause the mechanical actuator to actuate based on the request;

a tilt wand holder coupled, by an arm, to the housing, wherein the arm includes a first end connected to the housing and a second end coupled to the tilt wand holder by at least one pivot point, the at least one pivot allowing the arm to rotate relative to the housing, the tilt wand holder including a chamber configured to removably receive a tilt wand of the venetian window blind such that the tilt wand can extend through the chamber, the chamber interior including at least part of one or more wheels configured to contact the tilt wand such that actuation of the mechanical actuator causes the at least one wheel to rotate the tilt wand within the chamber.

2. The system of claim 1, wherein the receiver is at least one of an infrared receiver, a Bluetooth receiver, or a Wi-Fi signal receiver.

3. The system of claim 1, wherein the arm is a telescoping arm configured to extend outward from the housing.

4. The system of claim 1, wherein the tilt wand holder extends through the housing.

* * * * *